United States Patent [19]

Schriber

[11] 4,027,193

[45] May 31, 1977

[54] KLYSTRON-RESONANT CAVITY ACCELERATOR SYSTEM

[75] Inventor: Stanley O. Schriber, Deep River, Canada

[73] Assignee: Atomic Energy of Canada Limited, Ottawa, Canada

[22] Filed: Apr. 26, 1976

[21] Appl. No.: 680,537

Related U.S. Application Data

[63] Continuation-in-part of Ser. No. 554,775, March 3, 1975, abandoned.

[30] Foreign Application Priority Data

Mar. 4, 1974 Canada ..... 213044

[52] U.S. Cl. ..... 315/5.41; 315/3.5; 315/5.42

[51] Int. Cl.² ..... H01J 25/10

[58] Field of Search ..... 315/5.41, 5.42, 3.5

[56] References Cited

UNITED STATES PATENTS

| | | | |
|---|---|---|---|
| 2,556,978 | 6/1951 | Pierce | 315/5.42 |
| 2,813,996 | 11/1957 | Chodorow | 315/5.42 |
| 2,920,228 | 1/1960 | Ginzton | 315/5.41 X |
| 3,546,524 | 12/1970 | Stark | 315/5.41 |

*Primary Examiner*—Saxfield Chatmon, Jr.
*Attorney, Agent, or Firm*—Edward Rymek

[57] ABSTRACT

The klystron-resonant cavity accelerator system includes an accelerator structure having one or more sections of intercoupled resonant cavities which, with the output resonant cavity of a klystron, forms an integral rf coupled resonant cavity system for energizing the accelerator. The klystron and resonant cavity accelerator thus coupled also constitute a single evacuated system. The klystron output resonant cavity may be coupled to a resonant cavity in each of the accelerator sections by means of an energy coupling iris or by means of a intervening resonant coupling cell.

10 Claims, 1 Drawing Figure

KLYSTRON-RESONANT CAVITY ACCELERATOR SYSTEM

Figure 1:
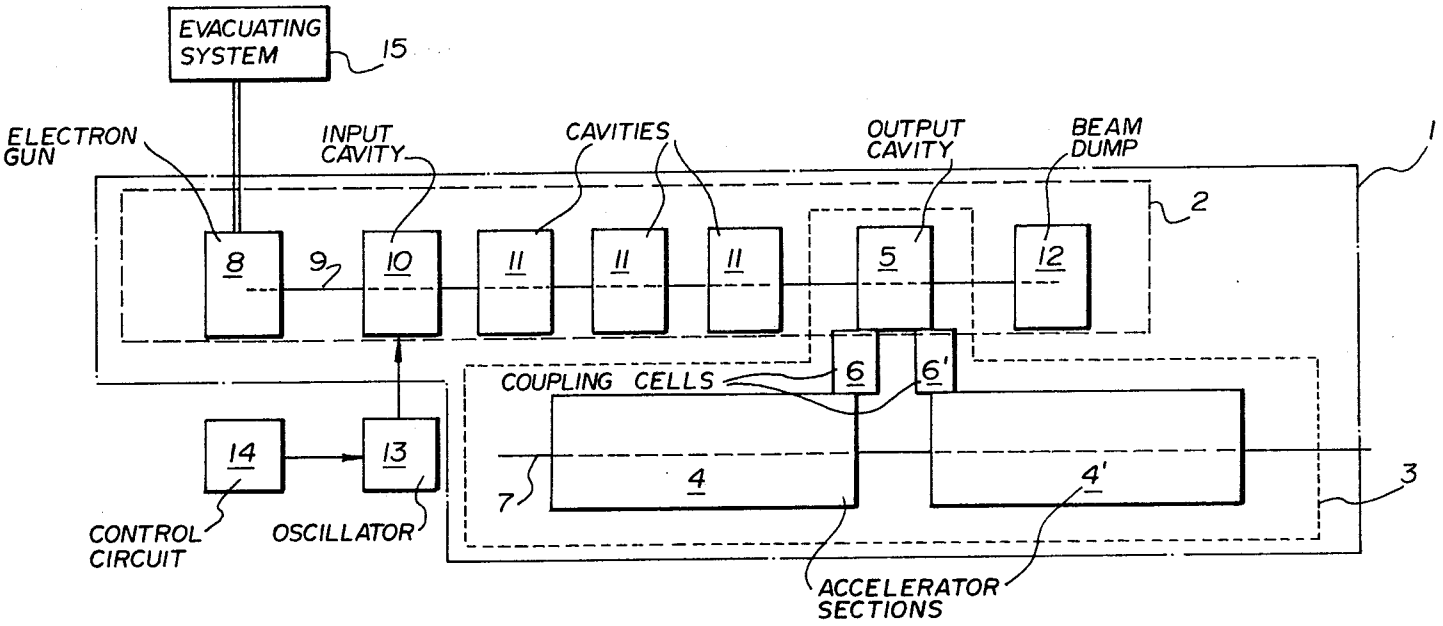

This application is a continuation-in-part of U.S. application Ser. No. 554,775, filed Mar. 3, 1975 now abandoned.

This invention is directed to a novel klystron accelerator arrangement and in particular to one in which the klystron and resonant cavity accelerator are incorporated into a single structure.

In conventional linear accelerator systems, a coupling cavity on the beam path in the accelerating section is used to couple power into the accelerating structure. Various designs have been used such as the SLAC design in which the transition from the rectangular waveguide is made by means of a matching iris and the coupler cavity is a regular accelerator cavity. In a second design, such as the C.S.F., the coupler cavity is much narrower and does not contribute substantially to electron acceleration. An example of a conventional microwave source-accelerator system is described in U.S. Pat. No. 3,546,524 issued on Dec. 8, 1970 to Peter G. Stark assignor to Varian Associates, wherein the particle accelerator is excited with microwave energy from a source connected to one of the accelerator cavities by means of a waveguide having a sealed microwave window to permit passage of microwave energy into the accelerator while forming a portion of the vacuum envelope of the accelerator section.

The conventional coupler cavities with their lateral apertures introduce both an amplitude asymmetry and a phase shift in the axial electric field as a function of the transverse coordinate, which may lead to problems in matching and tuning. In addition, rf vacuum windows are required between the source and the accelerator to maintain vacuum integrity in each, and high power waveguide components are required to connect the two.

It is therefore an object of this invention to provide a direct coupled rf power source and accelerator structure.

It is a further object of this invention to provide a single structure klystron-accelerator system having a single vacuum envelope.

It is another object of this invention to provide a compact efficient klystron-accelerator system.

These and other objects are achieved in a klystron-resonant cavity accelerator system wherein the accelerator which has one or more sections having intercoupled resonant cavities and the klystron which has an output resonant cavity that is excited by the klystron electron beam, are coupled together so as to form an integral rf coupled resonant cavity system for energizing the accelerator and a single klystron-accelerator evacuated system. The klystron output resonant cavity may be coupled to one of the resonant cavities in each of the accelerator sections by an energy coupling iris or by an intervening resonant coupling cell which is preferred for $\pi/2$ standing wave mode operation.

In the drawings

FIG. 1 schematically illustrates a klystron-resonant cavity accelerator system in accordance with the present invention.

The klystron-resonant cavity accelerator structure in FIG. 1 is enclosed within the dot-dash line block 1. It includes a klystron drive source enclosed within the dashed line block 2 and a linear accelerator enclosed within the dotted line block 3. The accelerator 3 consists of a number of resonant cavities formed into a section 4 which is mounted to provide an axial beam path 7 for a travelling or standing wave accelerating structure. Shown is a linear accelerator, however the present invention is not limited to linear accelerators. Conventional techniques are used for coupling the cavities together within the accelerator section and for determining the cavity profiles and cavity lengths. For a standing wave system, a second section 4' can be mounted as shown to provide a single axial beam path 7. A resonant cavity 5 which is mounted off to the accelerator beam axis 7, is coupled directly to the accelerator section 4, such as by a coupling iris. In the case of a standing wave system having accelerator sections 4 and 4', cavity 5 is coupled to both of the accelerating sections 4 and 4'. When the standing wave system is to be operated in the $\pi/2$mode, it is preferred that cavity 5 be coupled to the accelerating section 4 or sections 4 and 4' by a resonant coupling cell 6 or resonant coupling cells 6 and 6', respectively, since in the $\pi/2$ standing wave mode, cells 6 and 6' will have zero fields. Thus cavity 6 is an integral element in the coupled rf resonant cavity system of the accelerating structure 3.

The klystron-resonant cavity accelerator system 1 further includes a klystron 2 which has an electron gun 8 for providing a dc electron beam along a path 9 that is directed into the klystron input cavity 10. The input klystron cavity 10 can be driven by an oscillator controlled by a standard AFC regulation system or by a self-excited technique whereby the whole system is self-excited and the operating frequency is governed by adjustments of the rf phase between a signal pick up from the accelerator 3 and the input klystron cavity 10. Phase and amplitude control for the accelerator are realized by adjusting the oscillator 13 output relative to some reference control inputs 14. The dc electron beam from the gun 8 is bunched by the rf drive in the input klystron cavity 10 plus the action of a number of cavities 11, three being shown. This bunched beam is directed through cavity 5 which is mounted coaxially with the klystron beam axis 9 such that the beam sets up oscillating rf fields in cavity 5. The rf power generated in cavity 5 is dissipated by the accelerator structure and by energy gain of the accelerated beam since cavity 5 is coupled to the accelerator sections. Thus cavity 5 is also the output cavity for klystron 2. Cavity 5 is followed by a klystron beam dump 12 in which the klystron beam is absorbed.

Since components 8, 10, 11, 5 and 12 in klystron 2 have a beam hole for beam path 9 and since components 5, 6, 6', 4 and 4' are coupled to one another by coupling irises, the klystron-resonant cavity accelerator system enclosed within envelope 1 is evacuated to a suitably low pressure by a single evacuating system 15. The evacuating system 15 may be connected into the klystron 2 as illustrated schematically in FIG. 1 or connected into one of the accelerator sections 4 or 4'. This single evacuating system 15 eliminates the need for rf windows and the compact structure eliminates the need for high power waveguide components.

Some typical values of cw system are as follows. With a 40 kv, 5A gun (200kw) the klystron can deliver 100 kw to the accelerator assuming a 50% efficiency. This power is then used by the accelerator in accelerating a beam of current I to an energy E using Xkw of power to establish the rf fields.
i.e.

$$IE + X = 100 \text{ kw.}$$

If the klystron had a 50 db gain the drive power would be 1 watt.

I claim:

1. A klystron-resonant cavity accelerator system for accelerating a charged particle beam comprising:

evacuable accelerating section means having a predetermined number of intercoupled resonant cavities mounted about a common accelerator axis to provide an axial beam path for the charged particle beam to be accelerated;

evacuable klystron means having an output resonant cavity and means for passing a bunched electron beam through said output resonant cavity to excite rf fields within said output resonant cavity; and coupling means for coupling said klystron output resonant cavity to said accelerating section means to energize said accelerating section means, said accelerating section means with said coupling means and said output resonant cavity forming an integral rf coupled resonant cavity system, and said coupling means further connecting said klystron means to said accelerating section means to form a single evacuable system.

2. A klystron-resonant cavity accelerator system as claimed in claim 1 wherein said coupling means is a coupling iris located between the klystron output resonant cavity and one of the resonant cavities in the accelerating section means.

3. A klystron-resonant cavity accelerator system as claimed in claim 1 wherein said coupling means is a resonant coupling cell directly coupling said klystron resontant cavity to one of the resonant cavities in the accelerating section means.

4. A klystron-resonant cavity accelerator system as claimed in claim 3 wherein the accelerating section means is energized in the $\pi/2$ standing wave mode.

5. A klystron-resonant cavity accelerator system as claimed in claim 1 wherein said accelerating section means includes a first linear accelerator section and a second linear accelerator section mounted sequentially along the common accelerator axis; and said coupling means includes a first coupling iris located between the klystron output resonant cavity and one resonant cavity in the first linear accelerator section and a second coupling iris located between the klystron output resonant cavity and one resonant cavity in the second linear accelerator section.

6. A klystron-resonant cavity accelerator system as claimed in claim 1 wherein said accelerating section means includes a first linear accelerator section and a second linear accelerator section mounted sequentially along the common accelerator axis; and said coupling means includes a first resonant coupling cell and a second resonant coupling cell, said first resonant coupling cell directly coupling said klystron output resonant cavity to said first accelerator section and said second resonant coupling cell directly coupling said klystron output resonant cavity to said second accelerator section.

7. A klystron-resonant cavity accelerator system as claimed in claim 6 wherein said accelerator sections are excited in the $\pi/2$ standing wave mode.

8. A klystron-resonant cavity accelerator system for accelerating a charged particle beam comprising:

a first accelerator section and a second accelerator section positioned sequentially along a common accelerator axis to provide an axial beam path for the charged particle beam to be accelerated, each of said sections having a predetermined number of intercoupled resonant cavities;

klystron means having an output resonant cavity and means for passing a bunched electron beam through said output resonant cavity to excite rf fields within said output resonant cavity; and resonant coupling means for coupling said klystron output resonant cavity to said first accelerator section and said second accelerator section to energize said first and second accelerator sections, said first and second accelerator sections with said coupling means and said output resonant cavity forming an integral rf coupled resonant cavity system.

9. A klystron-resonant cavity accelerator system as claimed in claim 8 wherein said coupling means includes a first coupling iris located between the klystron output resonant cavity and one of the resonant cavities in the first accelerator section, and a second coupling iris located between the klystron output resonant cavity and one of the resonant cavities in the second accelerator sections.

10. A klystron-resonant cavity accelerator system as claimed in claim 8 wherein said coupling means includes a first resonant coupling cell and a second resonant coupling cell, said first resonant coupling cell directly coupling said klystron output resonant cavity to said first accelerator section and said second resonant coupling cell directly coupling said klystron output resonant cavity to said second accelerator section to energize said accelerator sections in the $\pi/2$ standing wave mode.

* * * * *